US005096428A

United States Patent [19]

Lwee et al.

[11] Patent Number: 5,096,428

[45] Date of Patent: Mar. 17, 1992

[54] HEADER DEVICE

[75] Inventors: Nai Hock Lwee; Meng Kuang Kan, both of Singapore, Singapore

[73] Assignee: E. I. Du Pont de Nemours and Company, Wilmington, Del.

[21] Appl. No.: 752,941

[22] Filed: Aug. 20, 1991

Related U.S. Application Data

[63] Continuation of Ser. No. 543,386, Jun. 26, 1990, abandoned.

[30] Foreign Application Priority Data

Jun. 30, 1989 [JP] Japan ..... 1-76433[U]

[51] Int. Cl.[5] ..... H01R 9/09

[52] U.S. Cl. ..... 439/79; 439/80; 439/83; 439/521

[58] Field of Search ..... 439/78, 79, 83, 135, 439/521, 892, 893

[56] References Cited

U.S. PATENT DOCUMENTS

| | | | |
|---|---|---|---|
| 3,315,217 | 4/1967 | Bird | 339/176 |
| 3,696,319 | 10/1972 | Olsson | 439/80 |
| 4,418,972 | 12/1983 | Benasutti | 439/79 |
| 4,577,921 | 3/1986 | Bogese II. | 339/176 |
| 4,639,056 | 1/1987 | Lindeman et al. | 429/736 |
| 4,715,829 | 12/1987 | Preputnick | 439/660 |
| 4,732,565 | 3/1988 | Ito et al. | 439/79 |
| 4,744,143 | 5/1988 | Sadigh-Benzadi | 439/83 |
| 4,750,889 | 6/1988 | Ignasiak et al. | 439/83 |
| 4,793,816 | 12/1988 | Pittman et al. | 439/79 |
| 4,808,115 | 2/1989 | Norton et al. | 439/79 |
| 4,872,848 | 10/1989 | Mouissie | 439/521 |

FOREIGN PATENT DOCUMENTS

| | | |
|---|---|---|
| 3603250 | 10/1988 | Fed. Rep. of Germany . |
| 8811877 | 12/1988 | Fed. Rep. of Germany . |
| 8704041 | 7/1987 | PCT Int'l Appl. . |
| 1413737 | 11/1975 | United Kingdom . |

*Primary Examiner*—Paula A. Bradley

[57] ABSTRACT

A header device comprises; a housing attached to an end face of a printed circuit board having through-holes; and a plurality of pins extending through and sealed to a first section of the housing, the first section facing the end face of the printed circuit board. The plurality of pins are arranged as an upper/lower array in a two-level structure at one surface of the first section of the housing; the pins of at least one of the two levels are bent within the first section and the pins of the respective level extend in the same plane out of the other surface of the first section of the housing; and the pins of the respective level, which extend in the same plane, are substantially vertically bent so as to insert forward portions of the pins into the through-holes of the printed circuit board.

6 Claims, 3 Drawing Sheets

HEADER DEVICE

This application is a continuation of application Ser. No. 07/543,386 filed Jun. 26, 1990, now abandoned.

BACKGROUND OF THE INVENTION

1. Field of the Invention

The present invention relates to a connector attached to an end face of a printed circuit board and, in particular, the present invention relates to a structure of a header device.

2. Description of the Related Art

As a low-profile connector attached to an end face of a printed circuit board, an edge mounted type connector 60 is known which has a two-level pin array as shown in FIG. 1. The edge mounted type connector 60 includes straight pins 62 and 63 in a two-level array in a housing 61 made of plastics. The connector 60 is attached to a printed circuit board 71 by soldering the forward end portions of the pins 62 and 63 to the corresponding surfaces of the printed circuit board.

In the edge mounted type connector 60, the pins undergo an axial force upon the insertion and withdrawal of them into and out of a female connector and are liable to be separated from the printed circuit board at the soldered spot. Furthermore, since the pins are merely inserted into corresponding holes in the housing, they are liable to be loosened in the holes, or slipped out of the housing, upon repeated mating and unmating of female connector.

SUMMARY OF THE INVENTION

It is accordingly the object of the present invention to provide a header device whose pins are hard to be separated from a printed circuit board and are prevented from any ready slippage out of a housing.

The aforementioned object can be achieved by a header device comprising a housing attached to an end face of printed circuit board having through-holes, and a plurality of pins extending through and sealed to a first section of the housing, the first section facing the end face of the printed circuit board, in which the plurality of pins are arranged as an upper/lower array in a two-level structure at one surface of the first section of the housing, the pins of at least one of the two levels are bent within the first section, the pins of the respective level extend in the same plane out of the other surface of the first section of the housing, and the pins of the respective level, which extend in the same plane, are substantially vertically bent so as to insert forward portions of the pins into the throughholes of the printed circuit board.

In the present header device, the pins extend horizontally in the same level out of the first section of the housing, and the forward end portion of the pin is bent as a hook form, inserted in the corresponding through-hole of the printed circuit board, and soldered there. As a result, even if a horizontal force is applied to the pin upon the insertion and withdraw of the pin into and out of a female connector, the pin can be prevented from a ready slippage out of the through-hole because of a solder bond force with which the pin is soldered to the through-hole and because of the latching of the vertically bent forward end portion of the pin to the through-hole. It is therefore possible to withstand the multi-mating and unmating of the female connector.

DETAILED DESCRIPTION OF THE PREFERRED EMBODIMENTS

The present invention will now be explained below with reference to the accompanying drawings.

Figure 1:
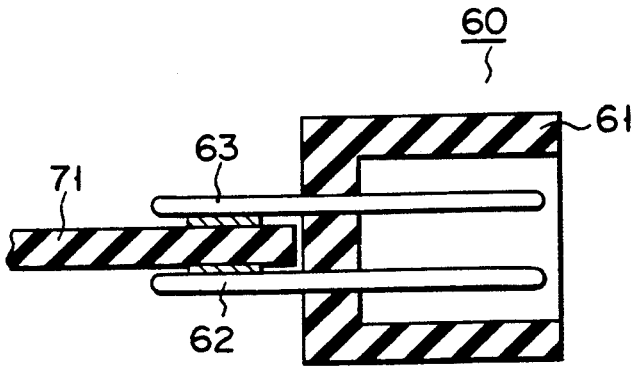
FIG. 1 (PRIOR ART)
FIG. 1 is a cross-sectional view showing a conventional edge mounted type connector.
Figure 2:
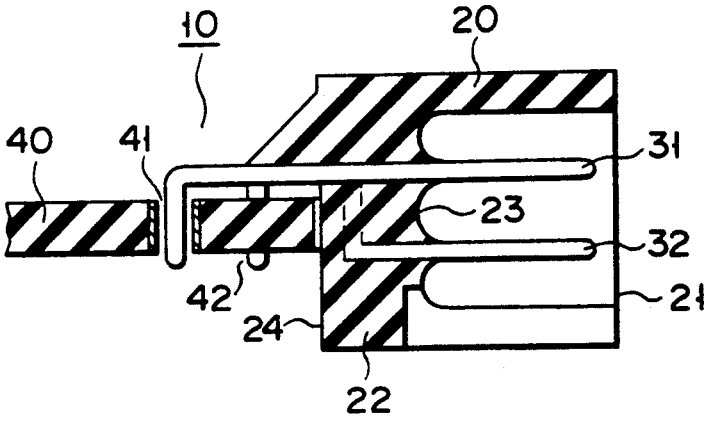
FIG. 2 is a cross-sectional view showing a header device according to one embodiment of the present invention.
Figure 3:
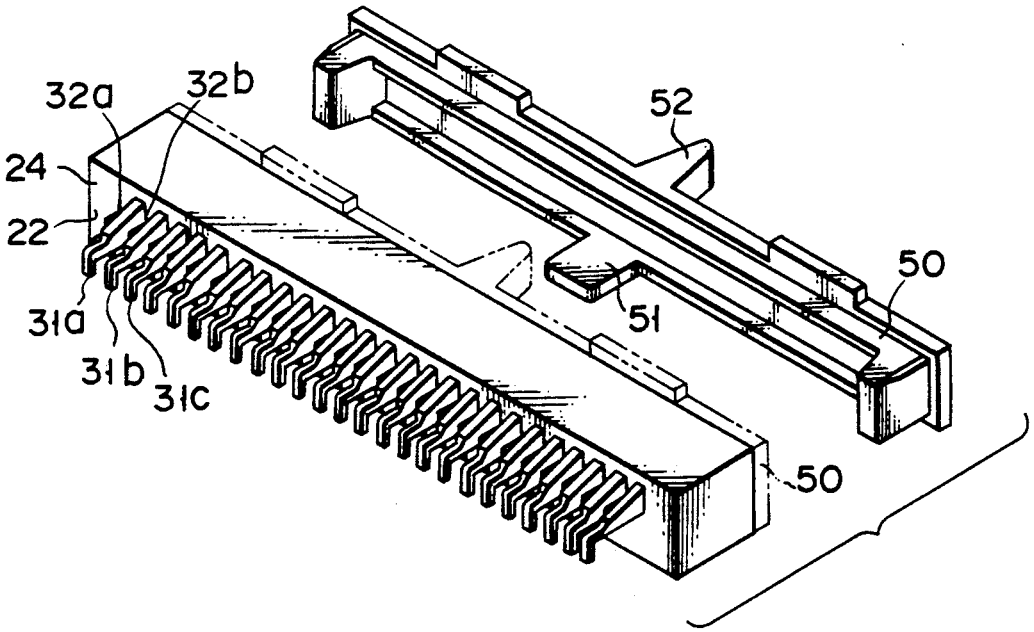
FIG. 3 is a perspective view showing the header device of FIG. 2 and a cover.

A header device 10 according to one embodiment of the present invention has an elongated-box type housing 20 as shown in FIGS. 2 and 3. The housing is opened at one side 21 as shown in FIG. 2. The housing has a first section 22 located opposite to the open side 21. A plurality of conductive pins 31 (31*a*, 31*b*, 31*c*, . . . ) and 32 (32*a*, 32*b*, 33*c* . . . ) extend through and are fixed to a first section 22 of the housing. The header device 10 is attached to the end face of the printed circuit board 40 such that the first section 22 of the housing 20 faces the end face of the printed circuit hoard with the forward end portions of the pins 31 and 32 inserted into through-holes 41 and 42 of the printed circuit board 40.

The pins 31 and 32 are so arranged that they extend in the two-level array from the inner surface 23 of the first section 22 of the housing. The pins 31 at the upper level extend horizontally through the first section 22 and extend from the outer surface 24 of the first section 22. The pins 32 at the lower level is bent at three places in the first section 22 and extends out of the outer surface 24 of the first section 22 at the same level as that of the upper pins 31.

More specifically, referring to FIG. 2, the pin 32 extends from the inner surface 23 to the inside of the first section 22 (toward the left in the drawing) along the same straight line as the pin 32 extends from the inner surface 23 toward the right in the drawing. In the first section 22, the pin 32 bends substantially at a right angle toward the back of the plane of the drawing, and again bends substantially at a right angle and extends uprightly, as shown by the broken lines in the drawing, to the height at which the pin 31 extends horizontally. Then, the pin 32 extends horizontally at the same height as the pin 31 toward the outer surface 24 and protrudes outwardly from the outer surface 24.

Figure 4:
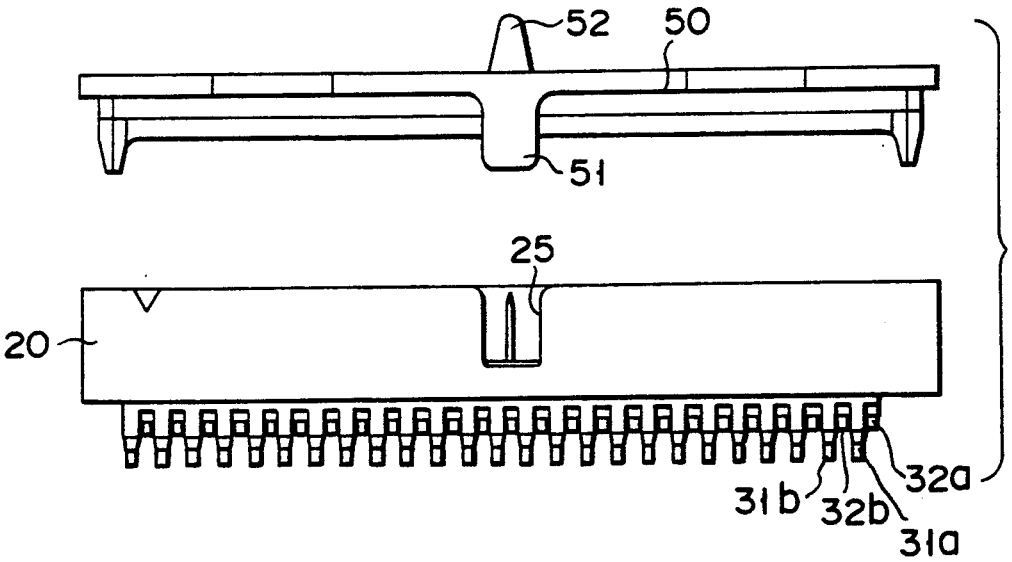
FIG. 4 is a plan view showing the header device and the cover of FIG. 3.

The pins 31 and 32 horizontally extending from the surface 24 are bent substantially vertically so that the forward end portions thereof are inserted into through-holes 41 and 42 in the printed circuit board 40. The forward end portions of the pins 31 and 32 thus inserted into the through-holes can be respectively soldered thereon. As shown in FIGS. 3 and 4, the pins 31 and 32 alternately extend horizontally out of the first section 22 and away from the outer surface 24 of the housing 20.

The present header device 10 can be manufactured by filling plastic material into a mold in which the pins 31 and 32 are positioned. The header device thus manufactured has their pins 31 and 32 encapsulated in and sealingly attached to the plastic housing 20.

Since the forward end portion of the pin is bent as a hook form, even if any horizontal force is applied to the pin upon the insertion and withdrawal of, for example, the female connector into and out of the header device, the pins can firmly be held relative to the printed circuit board due to a solder joint between the pins and the through-holes in the printed circuit board and the due to latch joint between forward end portions of the pins and the through-holes in the printed circuit board. Furthermore, as the pins are sealed to the housing, there is no possibility that, like the aforementioned conventional edge mounted type connector with pins merely inserted into the corresponding holes of the housing, the pins will be loosened in the holes of the housing or slipped out of the housing upon repeated insertion and withdrawal of a female connector into and out of the header device. The header device of the present invention can withstand multi-mating and unmating. Furthermore, since the pins at the upper and lower levels extend in the same plane, the header device of the present invention can achieve substantially the same height as the conventional edge mounted type connector.

In the present header device 10, as the material of which the housing 20 is made, use can preferably be made of high temperature plastics so that even if the pins 31 and 32 are jointed by, for example, a "wave soldering process" to the through-holes 41 and 42 they are not deformed by heat of a molten solder.

A cover 50 can be removably attached to the open side 21 of the housing 20. If, particularly, the wave soldering process employed for fully automated soldering process, the cover 50 can be used in which case neither a molten solder nor flux enters the housing to positively prevent a pin contamination. It is not possible to apply the wave soldering process to the conventional edge mounted type connector and it is necessary to perform a solder bond by a manual operation, so that an inconsistent quality solder joint is liable to be produced.

In the present header device 10, it is possible to automate a solder-bonding step, while using the cover 50, and to obtain a solder bond of stable quality and high reliability at a high productivity.

Figure 5:
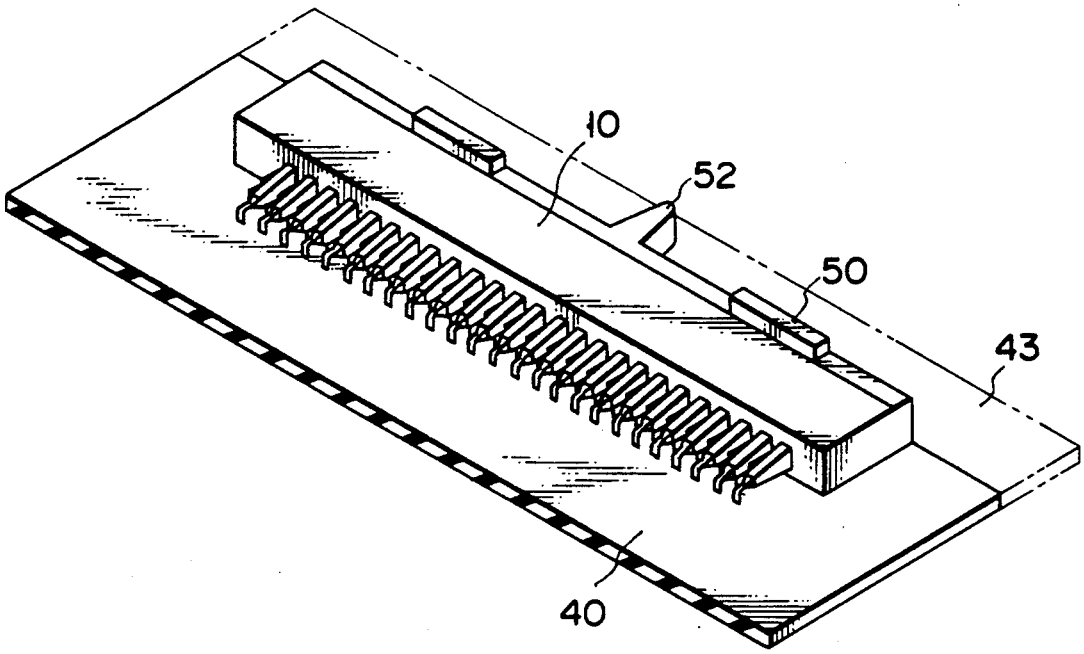
FIG. 5 is a perspective view showing the header device and cover of FIG. 3 attached to a printed circuit board.
Figure 6:
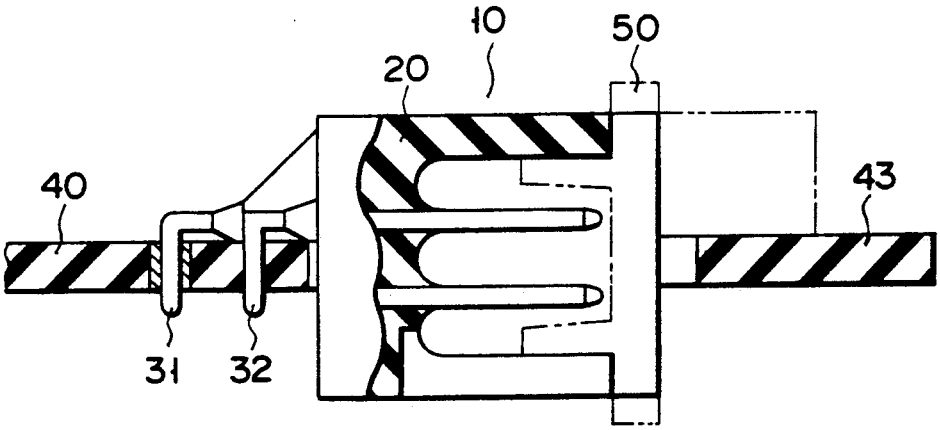
FIG. 6 is a cross-sectional view showing the device of FIG. 5.

As shown in FIG. 4, a tab 51 can be formed on the cover 50 to conform to a polarizing slot 25 in the housing 20. The slot 25 is closed with the tab 51. If the tab 51 is formed as breakable tab which is readily removed away from the body of the cover 50, for example, by bending, a common cover can be used for either a housing with a polarizing slot or a housing without a polarizing slot. A supporting tab 52 can be formed on the outer side of the cover 50. As shown in FIGS. 5 and 6, the supporting tab 52 is placed in contact with an auxiliary printed circuit board 43 as an extension of the printed circuit board 40 and stably supports the header device 10 on the printed circuit board 40 so as to prevent tilt of the header device 10 during a soldering process.

The header device 10 has been explained as one embodiment. The present invention is not restricted to the aforementioned embodiment in terms of the shape and array of pins. That is, so long as the pins extend inside the housing at the two-level array and outside the housing in the same plane, any pins of arbitrary shape can be employed and upper and lower pins can have the same shape.

As set forth above, in the present invention, it is achieved, to prevent a ready slippage of pins both out of the housing and out of the printed circuit board even upon the repeated insertion and withdrawal of connector such as a female connector. This can be achieved by sealingly fixing the pins to the housing and bending forward end portions of the pins, which extend out of the housing, substantially vertically so as to be inserted into the corresponding through-holes of the printed circuit board and soldered thereto.

What is claimed is:

1. An electronic connector for mounting on a circuit substrate comprising:

a housing of electrically insulating material provided at one side of the housing with a recess for receiving a mating connector and having at an opposite side of the housing a wall adapted for mounting against a side edge of said circuit substrate, and a plurality of electrical contacts disposed in said housing and extending from said recess through said wall, first portions of said contacts extending in said recess toward said one side of the housing and being arranged in at least two parallel rows extending perpendicularly and symmetrically with respect to said end face of the circuit substrate, one of said two parallel rows being in a plane near a top surface of said circuit substrate and the other of said two parallel rows being in a plane near a bottom surface of said circuit substrate, and second portions of said contacts extending through the wall at the opposite side of the housing and being arranged in a single row parallel to and extending closely adjacent said top surface of the circuit substrate.

2. The connector of claim 1 wherein the second portions of said contacts extending closely adjacent said top surface of the circuit substrate have end portions which are bent downward to extend perpendicularly through holes provided in said substrate for solder mounting in said holes.

3. The connector of claim 2 wherein the bent end portions are offset alternatively so as to form two parallel rows extending perpendicularly through two parallel rows of holes provided in said substrate.

4. The connector of claim 1 further including a removable cover of electrically insulating material adapted for attachment to said one side of the housing to cover said recess during soldering of said second portions of the contacts to the circuit board substrate, thereby preventing solder from contacting the first portions of the contacts extending in said recess.

5. The connector of claim 4 wherein said cover includes a removable polarizing tab adapted to be received in a slot formed at said first side of the housing.

6. The connector of claim 4 wherein said cover includes a supporting tab formed on a side of the cover opposite the side facing the connector housing, said supporting tab contacting an auxiliary circuit board substrate while supporting said housing on said circuit board substrate during soldering.

* * * * *